US012201248B2

(12) United States Patent
Gori et al.

(10) Patent No.: US 12,201,248 B2
(45) Date of Patent: Jan. 21, 2025

(54) TOOLS FOR CUSTOMIZING MODULAR SHOWER COMPONENTS

(71) Applicant: Leaf Home Safety Solutions, LLC, Hudson, OH (US)

(72) Inventors: Michael Gori, Norton, OH (US); Thomas Victor Czerny, Streetsboro, OH (US)

( * ) Notice: Subject to any disclaimer, the term of this patent is extended or adjusted under 35 U.S.C. 154(b) by 122 days.

(21) Appl. No.: 17/933,338

(22) Filed: Sep. 19, 2022

(65) Prior Publication Data

US 2024/0065490 A1 Feb. 29, 2024

Related U.S. Application Data

(60) Provisional application No. 63/374,157, filed on Aug. 31, 2022.

(51) Int. Cl.
*A47K 3/28* (2006.01)

(52) U.S. Cl.
CPC ..... *A47K 3/284* (2013.01)

(58) Field of Classification Search
CPC ..... A47K 3/284
USPC ..... 4/596, 612–614, DIG. 9
See application file for complete search history.

(56) References Cited

U.S. PATENT DOCUMENTS

2013/0025044 A1* 1/2013 Moyer ..... A47K 3/284 4/614
2013/0061388 A1* 3/2013 Lebrun ..... A47K 3/284 4/613
2014/0331598 A1* 11/2014 White ..... A47K 3/04 52/775

* cited by examiner

*Primary Examiner* — Tuan N Nguyen
(74) *Attorney, Agent, or Firm* — Benesch Friedlander Coplan & Aronoff LLP

(57) ABSTRACT

Disclosed herein are methods and tools for customizing shower panels to accommodate a variety of shapes and sizes of shower bases, where such methods and tools reduce installation steps. One exemplary method includes steps of using tools to trim a back shower panel, a first side shower panel, and a second side shower panel to conform to the contours of the top edges of a shower base. An exemplary assembly of tools used to perform described methods includes a plurality of contour gauge tools and a drain center groove. Each contour gauge tool includes a contoured edge, a slot formed through the contour gauge tool, and indicia formed on a surface of the contour gauge tool. The drain center tool includes a first groove, second groove intersecting the first groove and perpendicular to the first groove, and a tab extending upward of the top surface of the drain center tool.

23 Claims, 24 Drawing Sheets

TOOLS FOR CUSTOMIZING MODULAR SHOWER COMPONENTS

CROSS-REFERENCE TO RELATED APPLICATIONS

This application claims priority to pending U.S. Provisional Patent Application Ser. No. 63/374,157, titled "Tools for Customizing Modular Shower Components" and filed on Aug. 31, 2022, which is expressly incorporated by reference herein in its entirety.

FIELD OF INVENTION

The present disclosure generally relates to methods and systems for customizing components for a modular shower. More specifically, the present disclosure relates to methods and systems for customizing shower panels to accommodate a variety of shapes and sizes of shower bases.

BACKGROUND

In recent years, the requirements and demands of the residential home remodeling and home improvement markets have evolved to include a broader demographic and an ever-growing variety of services. Traditionally, most consumers could justify the cost of remodeling a home because remodeling increases the value of the home, repairs defects to the home, improves energy efficiency, and/or updates the aesthetic styling and amenities of the home. However, with the increased aging of the world's population, particularly in industrialized countries, more and more consumers are remodeling homes to satisfy aging consumers' desires to safely remain in their homes longer despite physical limitations that come with aging. In addition to the understandable desire to continue to live independently, the cost of in-home care, assisted living facilities, and other such alternatives often provide an economic incentive for aging consumers to remodel their residential homes.

As noted, today's older consumers are more independent and commonly choose to remain in their residential home much longer than prior generations. In one estimate, the number of Americans over the age of 65 will increase from 54 million in 2020 to 80 million in 2040, which includes a doubling of Americans over the age of 85 from 7 million to 15 million. This growth in the number of aging Americans has a proportional effect on the number of homeowners over the age of 65. In the last decade, the number of homeowners over the age of 65 has increased by 9 million (roughly a 35% increase since 2010), and it is expected that this number will grow by an additional 19.3 million in the next 10 years (roughly a 40% increase over 2020). As the population ages, many more home remodeling projects will focus on making the home safer for aging Americans, particularly those with mobility imitations, that desire to remain in their homes. Even today, 45% of consumers cite making a home safer and more useable for an aging resident as one of the reasons for remodeling a home. This percentage is sure to grow in the coming years.

While there are often many projects required to make a home safe and efficient for an aging resident, one room that is the sensible focus of many remodeling projects is the bathroom. The bathroom is of course often used for bathing and showering, which leads to wet and slippery surfaces. In addition, many bathroom surfaces are hard and rigid, which presents substantial risk of accidents that result in injury for aging persons and any other residents with mobility and balance challenges. For any aging person to remain in his or her residential home, making the bathroom safe and efficient to use must be a high priority.

Most existing homes are designed for raising a family. Most homes include a tub and shower combination 10, such as illustrated in FIG. 1. Such a tub and shower combination 10 makes sense for homes where children are bathed and agile adults take showers. However, in order for an aging person to use such a tub and shower combination 10, he or she must step over the front wall 20 of the tub portion onto a likely wet and slippery surface. The aging person must maintain his or her balance while supporting themselves on one leg and crossing the other leg over the front wall 20 of the tub portion to enter or exit the tub and shower combination 10. As is readily understood, such situations are ripe for accidents and injury of aging persons and anyone struggling with mobility and balance issues.

Even when a home includes a traditional single purpose shower 30, such as illustrated in FIG. 2, danger is also present. Although there is no tub wall to present an obstacle, aging persons must still navigate wet and slippery surfaces without the benefit or aid of secure locations to grasp to maintain balance and avoid accidents. As illustrated in FIG. 2, most single purpose showers 30 do not traditionally include grab bars or non-slippery surfaces to assist those with mobility and balance challenges. To retrofit a traditional single purpose shower with safety features, particularly an older single purpose shower made from materials that have grown brittle and/or fragile over time, may not be a realistic option for many existing homes.

Therefore, remodeling a bathroom by removing an existing shower and tub combination 10 or traditional single purpose shower 30 and installing a new replacement shower that offers safety features is often the best option for an aging person that desires to continue living independently in a residential home. Current replacement showers for residential homes typically come in two styles: (i) a monolithic preformed shower fabricated in a few standard shapes and sizes and (ii) showers that are built from customizable modular components such as a shower base that forms the floor of the shower and shower panels that form the walls of the shower. If the standard shapes and sizes of the monolithic preformed showers do not accommodate a particular bathroom, then the shower will typically need to be constructed from customizable modular components to complete the remodeling project.

In order for a shower constructed from modular components to effectively capture water falling from the showerhead and channel that water to a drain formed in the shower base, the modular shower components must fit together without any significant gaps between the components. This is a challenge since often a modular shower base includes curved and inclined surfaces, which facilitate the channeling of water to the drain. Additionally, even the drain may be placed in various locations in the shower base to accommodate the position of the drain in the floor of the bathroom. Shower bases are commonly fabricated in a few standard sizes. Typically, if a consumer's bathroom requires a custom sized shower base, one must be custom manufactured specifically for their home. Alternatively, a shower base could be fabricated on-site to custom fit the size and drain location requirements of a consumer bathroom. This may require cutting a pre-sloped floor to the specific size required to fit a particular footprint in a bathroom. As will be appreciated, when cutting a shower base to match a given footprint and the drain, the locations and shapes of the contours of the shower base are unpredictable. Because the shower panels engage with the top edges of the shower base, the bottom edges of the shower panels must be customized to accommodate these unpredictable and variable contours of the shower base.

Current methods for cutting the bottom edges of shower panels includes using cardboard or paper to trace the contours of the top edges of the shower base, cutting the cardboard or paper into a template, placing the template adjacent to the bottom edge of the applicable shower panel, tracing the pattern of the template near the bottom edge of the shower panel, and cutting the shower panel by following the template. As will be appreciated, this method is fairly inaccurate and error prone and is also time consuming and inefficient. This method often leads to poor results that are costly for the consumer. If the customized bottom edges of the shower panels do not correspond closely enough to the top edges of the shower base, then water can seep between the shower panels and shower base and lead to significant and costly water damage to the home.

Therefore, it is desirable to develop a more efficient and accurate approach to customizing shower panels to properly engage with a shower base without any significant gaps. Tools and methods of using such tools that meet these needs are disclosed and described herein.

SUMMARY

Disclosed herein are methods and tools for customizing shower panels to accommodate a variety of shapes and sizes of shower bases. One exemplary method of preparing and installing shower panels for a modular shower include the initial step of selecting prefabricated components including a shower base, a back shower panel, a first side shower panel, and a second side shower panel. The shower base includes a first top edge, a second top edge, a third top edge, and a drain hole. The back shower panel includes a left vertical edge, a right vertical edge, a top edge, and a bottom edge. The first side shower panel includes a left vertical edge, a right vertical edge, a top edge, and a bottom edge. The second side shower panel includes a left vertical edge, a right vertical edge, a top edge, and a bottom edge. Additional steps include: (i) measuring a first distance from the drain hole to the first top edge, measuring a second distance from the drain hole to the second top edge, and measuring a third distance from the drain hole to the third top edge; (ii) placing a first indicator on the first side shower panel proximate to the bottom edge of the first side shower panel corresponding with the second distance, placing a second indicator on the back shower panel proximate to the bottom edge of the back shower panel that corresponds with the first distance and the third distance, and placing a third indicator on the second side shower panel proximate to the bottom edge of the second side shower panel corresponding with the second distance; and (iii) aligning a contour gauge tool with the first indicator and trimming the bottom edge of the first side shower panel based on the contour gauge tool, aligning a contour gauge tool with the second indicator and trimming the bottom edge of the back shower panel based on the contour gauge tool, and aligning a contour gauge tool with the third indicator and trimming the bottom edge of the second side shower panel based on the contour gauge tool.

An exemplary assembly of tools used to perform described methods includes a plurality of contour gauge tools and a drain center groove. Each contour gauge tool includes a contoured edge, a slot formed through the contour gauge tool, and indicia formed on a surface of the contour gauge tool. The drain center tool includes a first groove, a second groove intersecting the first groove and perpendicular to the first groove, and a tab extending upward of the top surface of the drain center tool.

BRIEF DESCRIPTION OF THE DRAWINGS

In the accompanying drawings, structures are illustrated that, together with the detailed description provided below, describe example embodiments of the disclosed apparatus and methods. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

The apparatus, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of tools for use in customizing components, specifically shower panels, are hereinafter disclosed and described in detail with reference made to FIGS. 1-24.

As will be described in detail herein, this disclosure is directed to embodiments of tools useful for customizing shower panels to accommodate the contours of a customized shower base. In particular, the tools facilitate the cutting of the bottom edges of shower panels so that such bottom edges of shower panels engage with the top edges of the shower base without any significant gaps between the shower panels and the shower base when the components are assembled into a shower.

Figure 1:
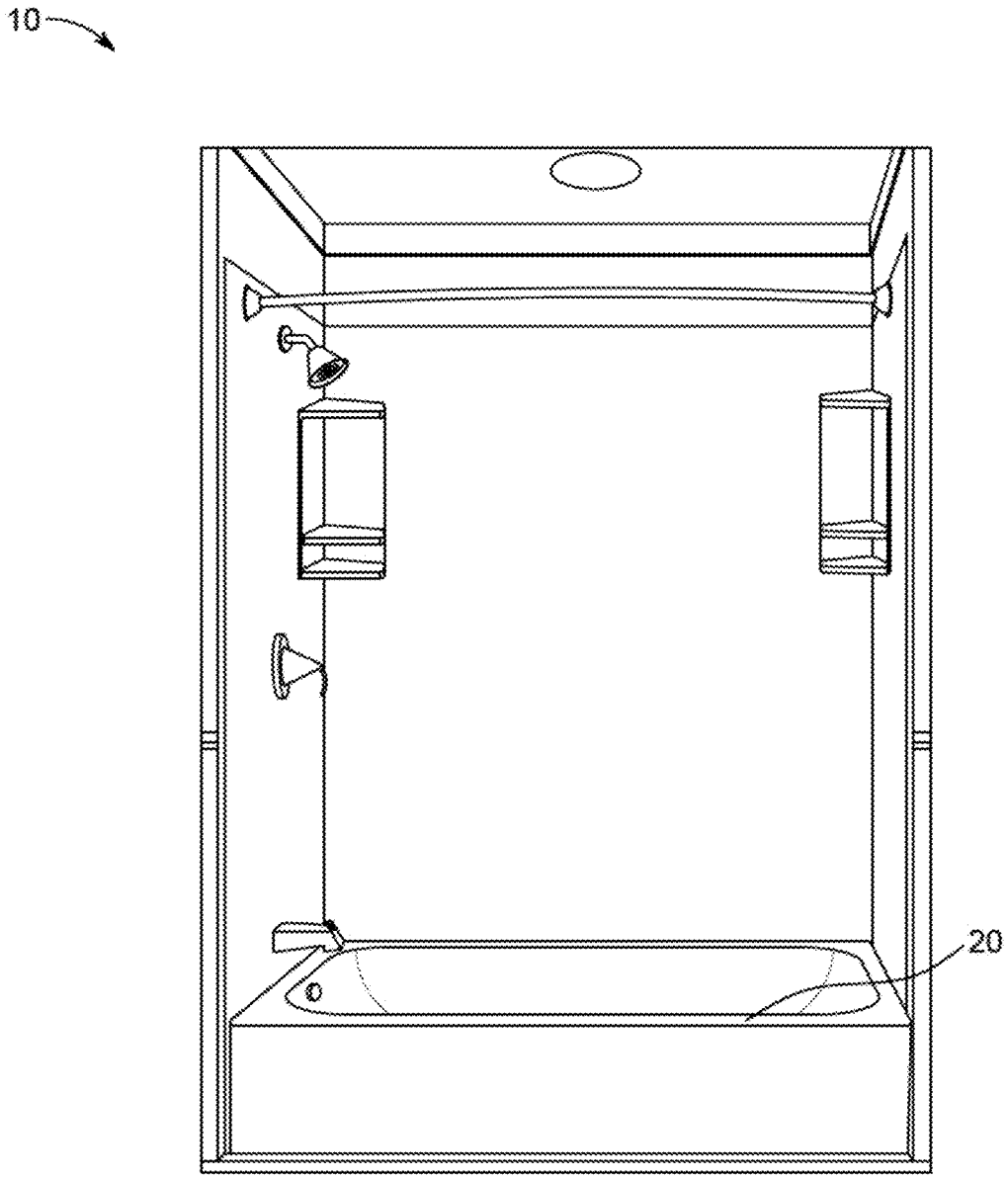
FIG. 1 Prior Art
FIG. 1 is a schematic perspective view of a prior art tub and shower combination for use in a residential bathroom.
Figure 2:
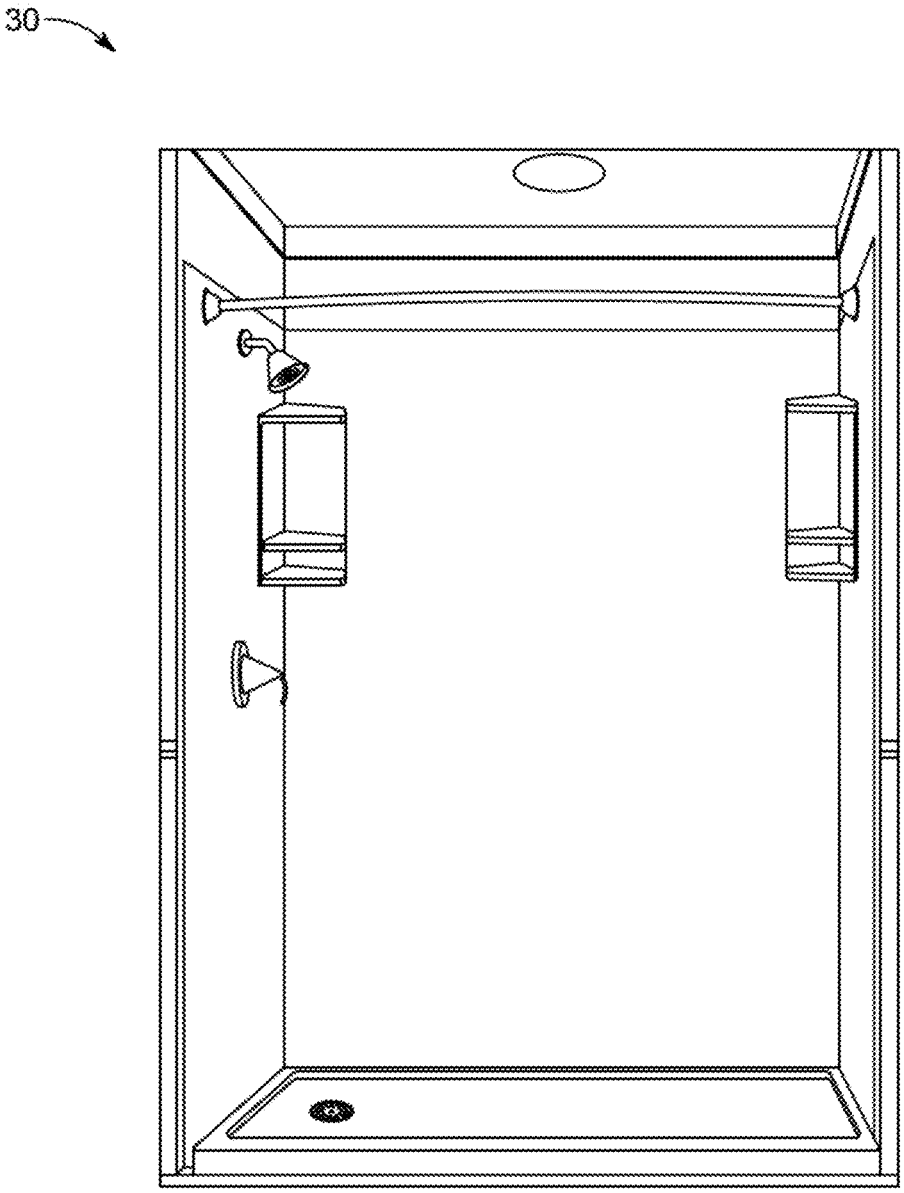
FIG. 2 Prior Art
FIG. 2 is a schematic perspective view of a prior art single purpose shower for use in a residential bathroom.
Figure 3:
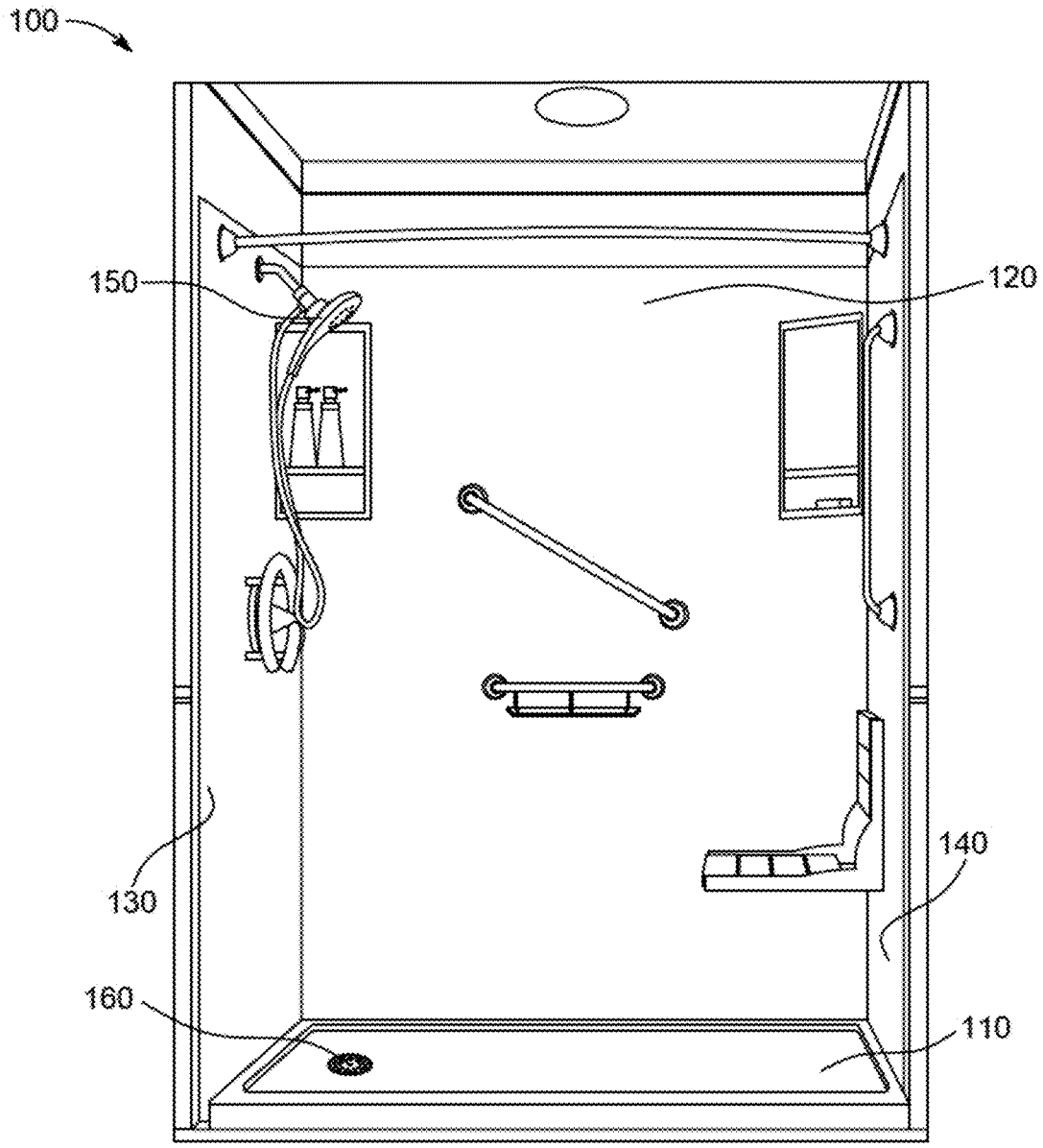
FIG. 3 is a schematic perspective view of a modular safety shower with an offset drain for use in a residential bathroom.
Figure 4:
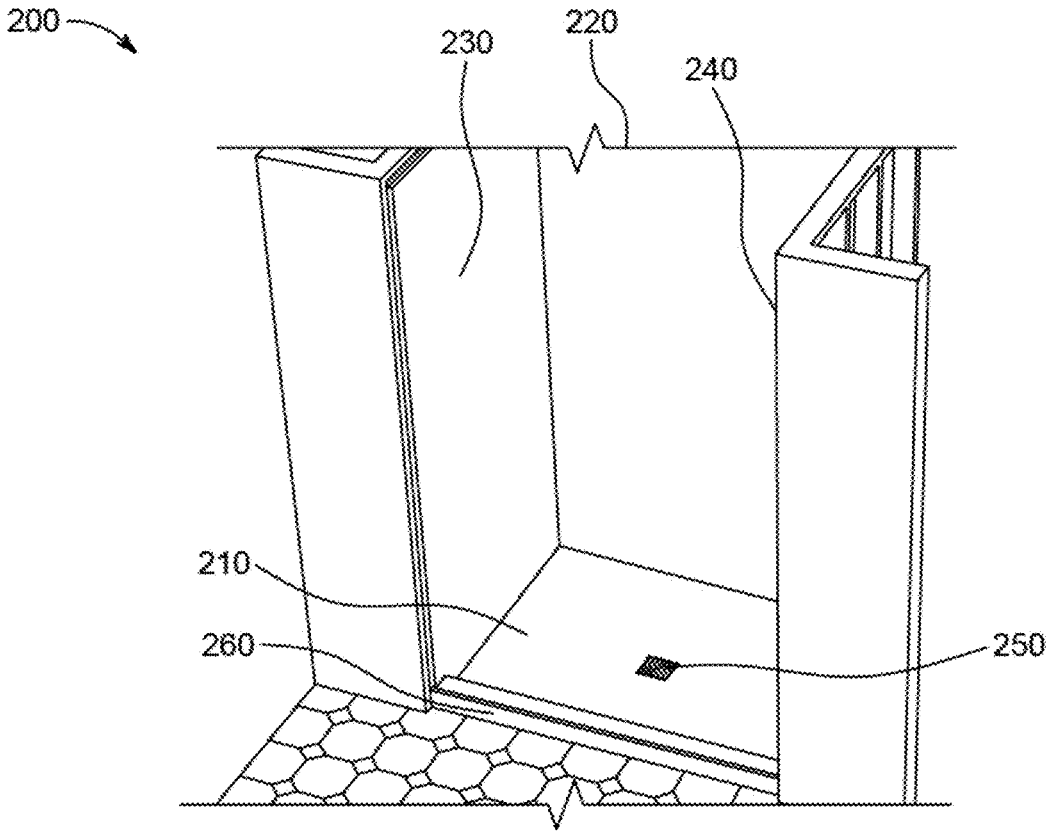
FIG. 4 is a schematic perspective view of a modular shower with a centered drain.

Modular shower kits can include one or more shower bases and one or more shower panels. Shower panels are relatively thin moisture resistant panels that attached to the existing walls of a home when installing a modular shower. The shower bases and shower panels can be fabricated in a few sizes, typically larger than is needed, and subsequently cut to the precise dimensions required for each specific bathroom. An exemplary modular shower 100 is illustrated in FIG. 3. Such a shower 100 includes a modular base 110, a back shower panel 120, a first side shower panel 130, and a second side shower panel 140. In the modular shower 100 of FIG. 3, a showerhead 150 extends from the first side shower panel 130, which can also be referred to as a wet wall. The drain 160 is offset in the shower base 110, with the drain 160 located closer to the wet wall 130 than the second side panel 140. FIG. 4 schematically illustrates another exemplary modular shower 200 that includes a modular base 210, a back shower panel, 220, a first side shower panel 230, a second side shower panel 240, and a drain 250 that is centered between the first side shower panel 230 and second side shower panel 240 and further centered between the back shower panel 220 and a threshold 260 at the opening of the modular shower 200. A modular base 210 could have been modified differently such that the drain 250 is not centered in the modular shower 200. This would be necessary if existing plumbing is also not centered in the modular shower 200. Thus, the modular base 210 can be customized not only in the width and length directions, but also to fit a plurality of potential existing drain locations.

When a consumer decides to remodel a bathroom to include a modular shower, there remain a number of logistical issues. For example, it will be understood that requirements for the size and shape of a modular shower for remodeling an existing bathroom are substantially more complicated than designing a bathroom for a new home. A shower may need to be relocated and sized to accommodate other features in a remodeled bathroom, including safety features installed for consumers that require a safer environment in his or her home. For example, when remodeling a bathroom for an aging person, there is often more space allotted around a toilet for ease of use, handrails, grab bars and guardrails installed throughout the bathroom, and enlarged vanities with seating are installed to facilitate aging persons fully utilizing the bathroom and its amenities. Thus, it is often necessary to select an unconventional size and shape of a shower to accommodate space limitations and the other safety features to fully take advantage of the existing footprint of a bathroom remodeled for an aging person. Additionally, when remodeling an existing bathroom, one often does not fully know the shower requirements prior to starting the remodeling project. Remodeling can occur in any age range of homes, where any number of building materials could be present, and the existing bathroom could or could not have been built to any number of different building codes. Thus, further complicating this process when compared to designing a bathroom for a new home. Only once the existing shower is removed and an installer is able to see the condition of the existing subfloor and walls behind the existing shower, they will then fully understand the requirements of the remodeling situation and the requirements of the new shower. This further exacerbates the need for custom solutions as are often required in a bathroom remodeling situation.

Figure 5:
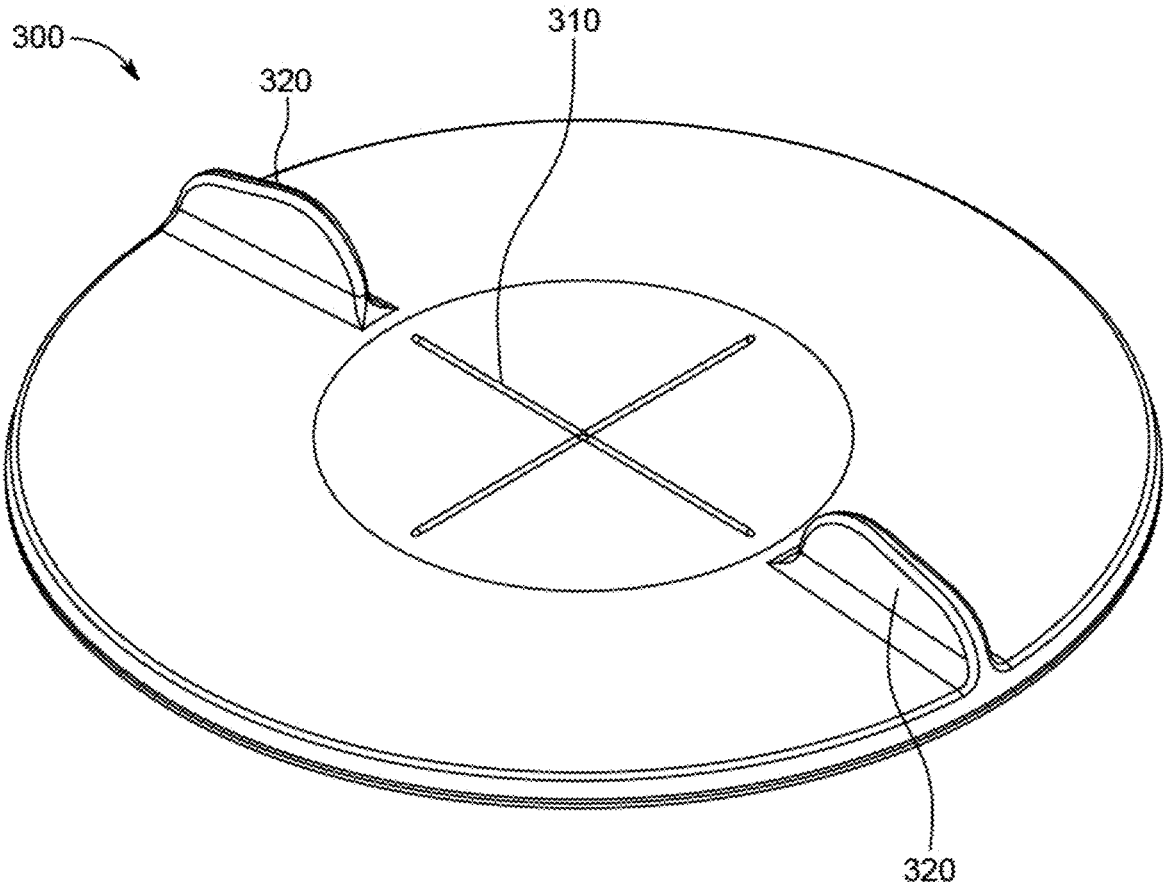
FIG. 5 schematically illustrates a perspective view of a drain center tool.
Figure 6:
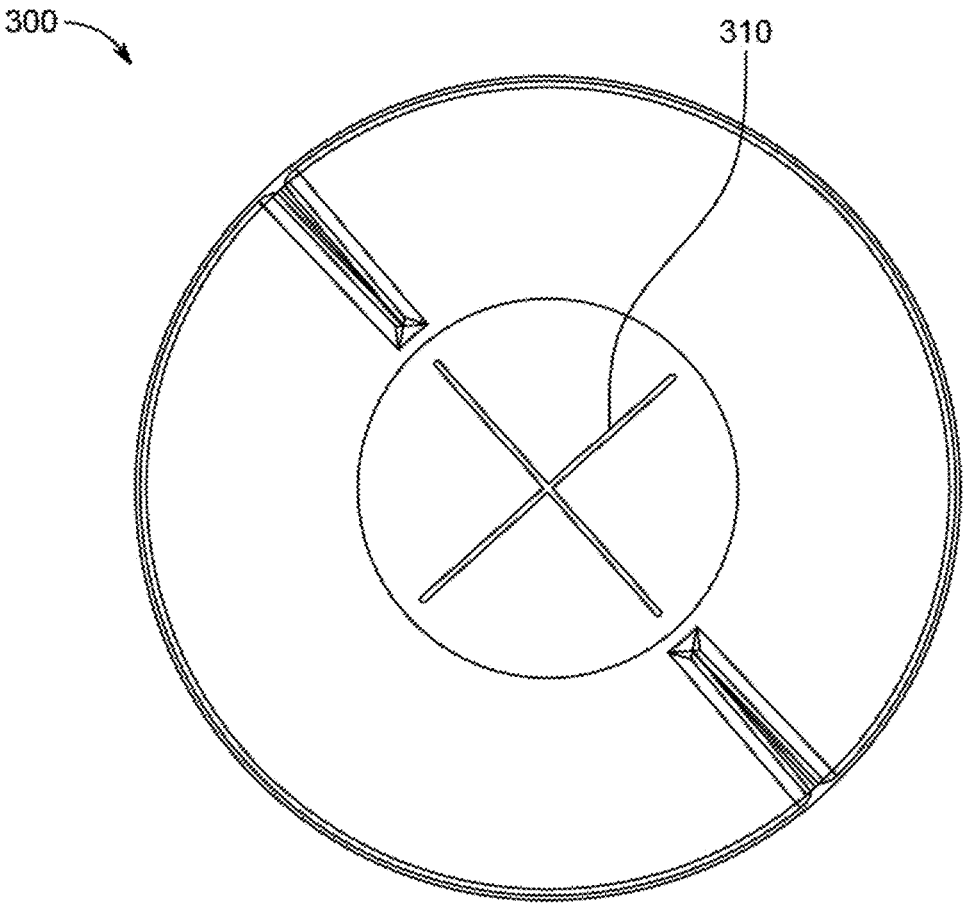
FIG. 6 schematically illustrates a top view of the drain center tool of FIG. 5.
Figure 7:
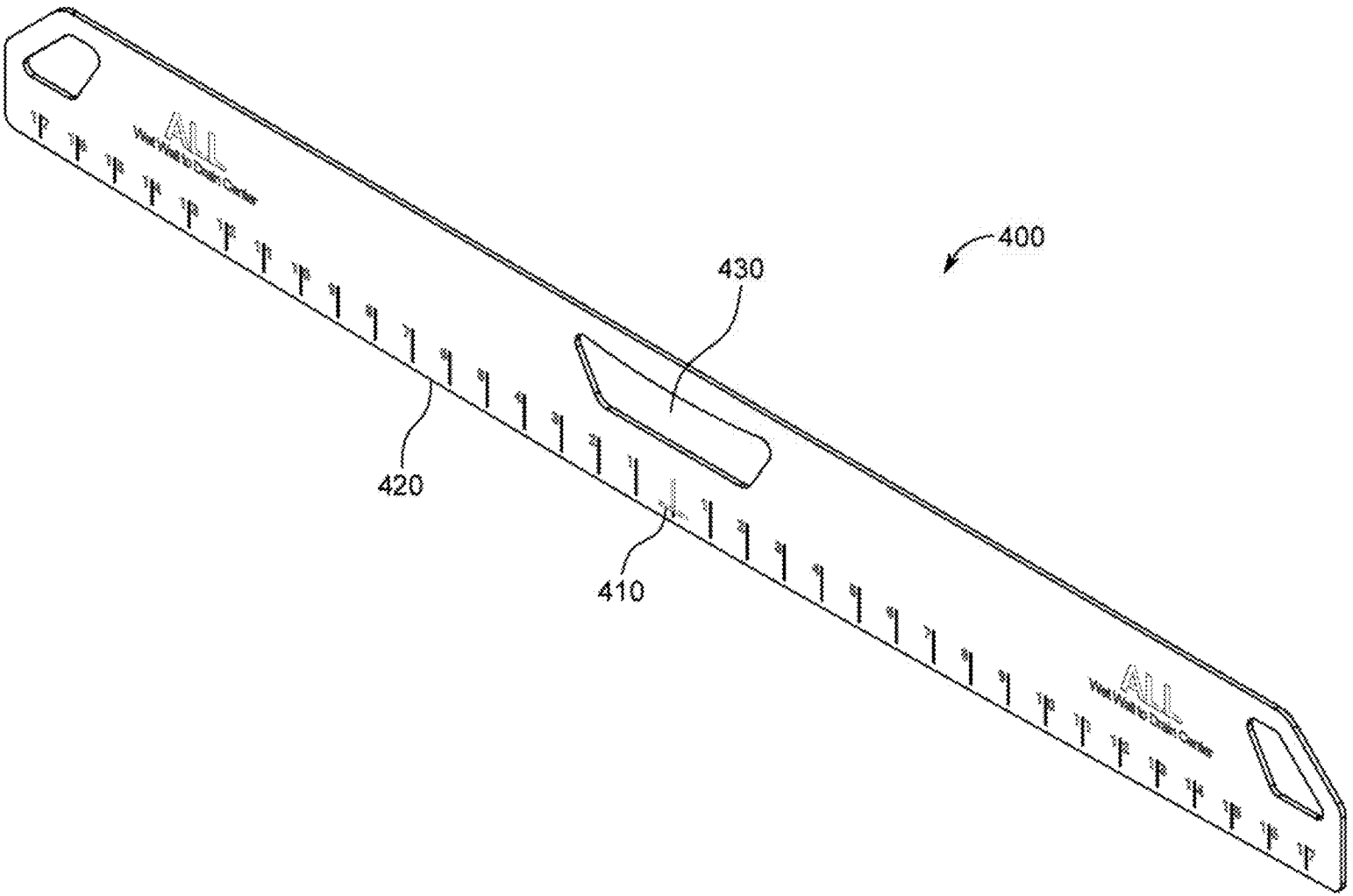
FIG. 7 schematically illustrates a perspective view of a contour gauge tool.
Figure 8:
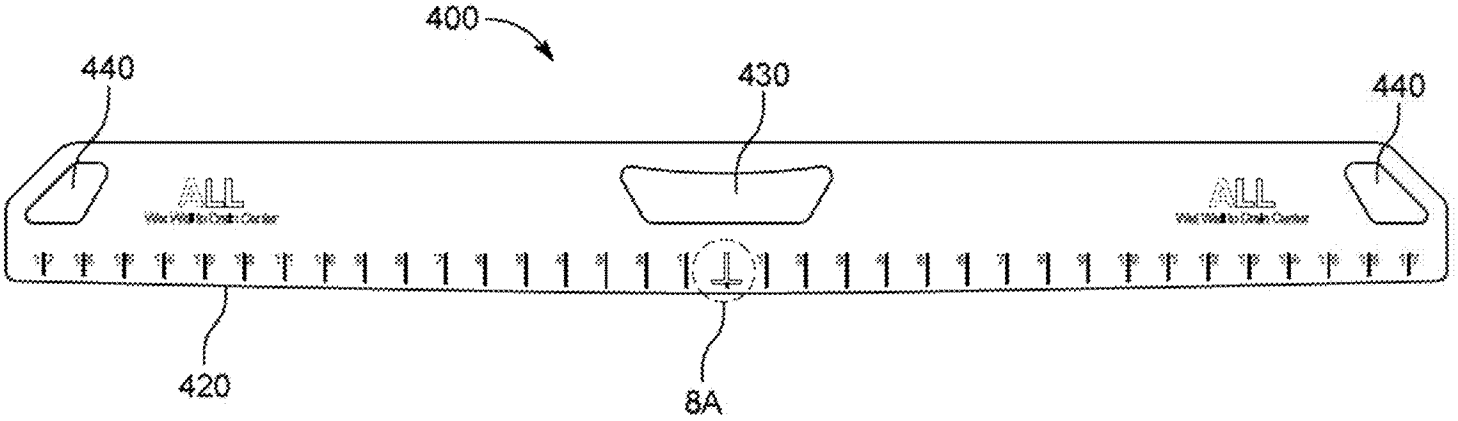
FIG. 8 schematically illustrates a front plan view of the contour gauge tool of FIG. 7.
Figure 8A:
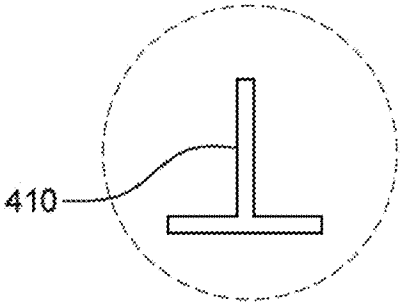
FIG. 8A illustrates a t-shaped slot of the contour gauge tool of FIG. 7.
Figure 9:
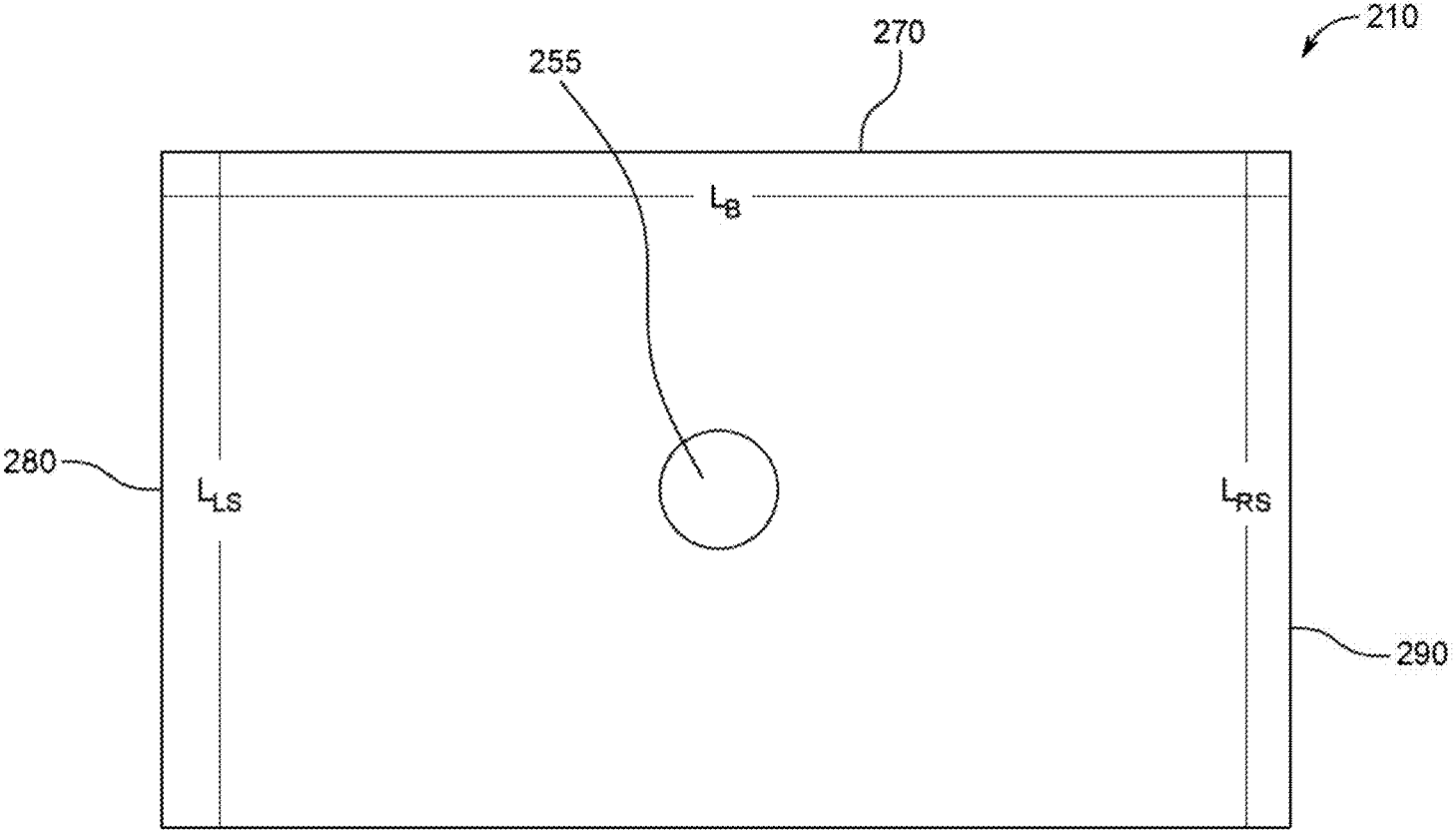
FIG. 9 schematically illustrates a top view of a shower base with a centered drain.

Disclosed herein is a set of tools that facilitate an accurate, efficient, and repeatable method for trimming shower panels to accommodate customized shower bases. FIGS. 5-8 schematically illustrate exemplary embodiments of such tools. FIGS. 5 and 6 illustrate a perspective view and top view, respectively, of a drain center tool 300. FIGS. 7 and 8 illustrate a perspective view and top view, respectively, of one embodiment of a contour gauge tool 400. FIG. 8A illustrates a detailed view of a t-shaped slot 410 formed in the contour gauge tool 400. As will be further described, there are multiple contour gauge tools that are designed for various sizes and drain configurations for shower bases as well as whether the shower panel is a side panel (including the distinction between a wet wall and the opposing side shower panel) or back panel. The tools illustrated are used by installers to quickly identify the location and path of cuts required to trim the bottom edges of side and back shower panels to appropriately fit on top of the shower base. The method described with reference to FIGS. 5-8A are for use with the example of a shower base 210 with a centered drain as illustrated in FIG. 9.

In this example, the modular shower requires one back shower panel, a wet wall, and a side shower panel opposite the wet wall. Once the shower base 210 has been selected and trimmed to the appropriate size that accommodates the specific bathroom and a drain hole 255 drilled or otherwise formed through the shower base 210 to match the drain in the floor of the bathroom, the installer selects an appropriate back shower panel and two appropriate side shower panels (one that will serve as a wet wall and one that will be installed opposite the wet wall). The back shower panel is selected to best match the length (LB) of the back edge 270 of the shower base 210 (as illustrated in FIG. 9). The wet wall is selected to best match the length (LLs) of the left side edge 280 of the shower base 210. The side shower panel is selected to best match the length (LRS) of the right side edge 290 of the shower base 210. If the width of the selected back, wet wall, and side shower panels do not match the respective lengths (LB, LLS, LRS) of the shower base 210, the back and side shower panels are trimmed to match the respective lengths using a method described herein.

Figure 10:
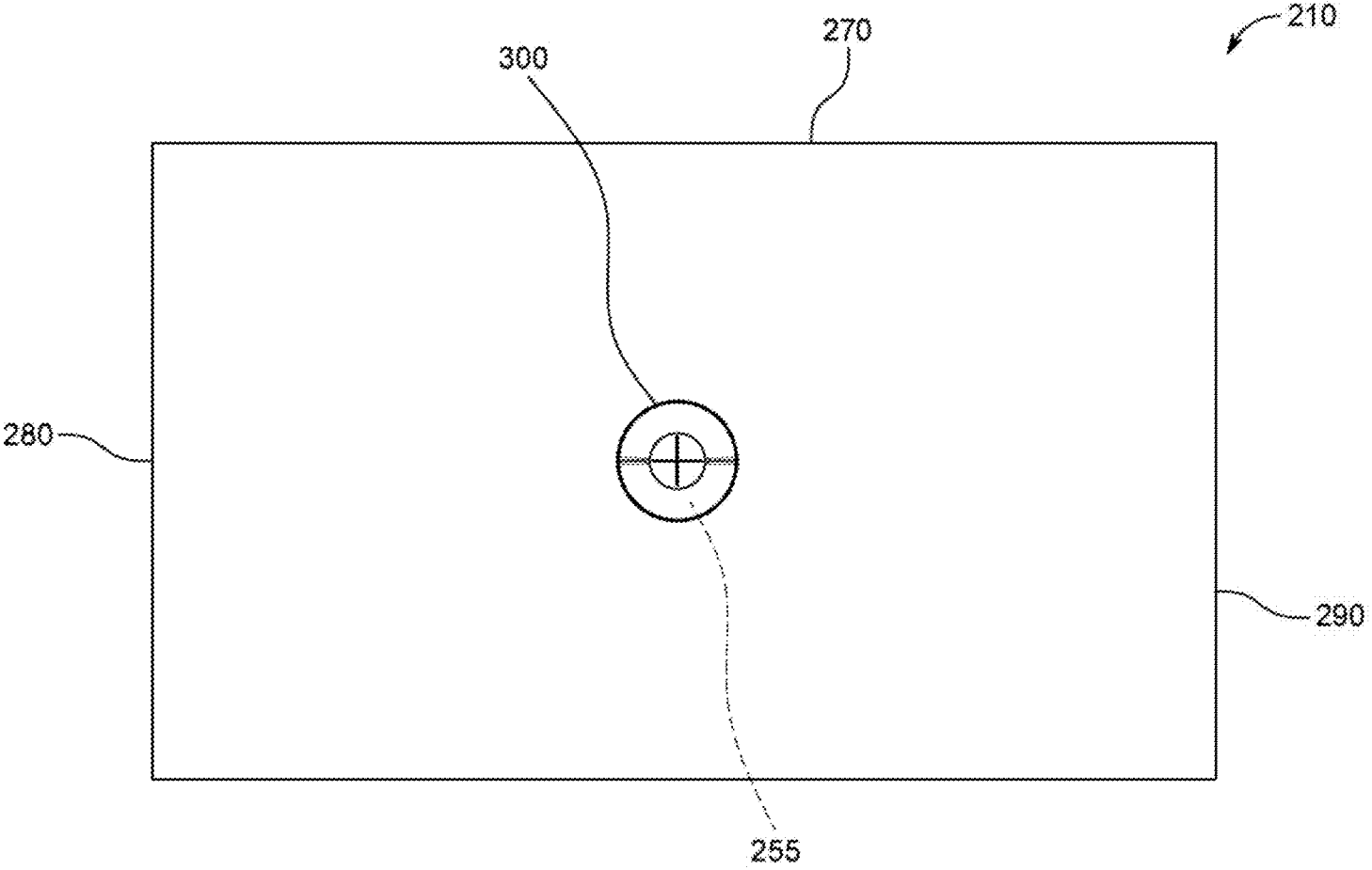
FIG. 10 schematically illustrates a top view of a shower base with a drain center tool inserted into the drain.

The installer measures the location of the drain hole 255 relative to the back 270 and side 280, 290 edges of the shower base 210 using any conventional measuring method. The drain center tool 300 can be used by the installer to facilitate such measurements. As illustrated in FIG. 10, the drain center tool 300 can be inserted into the drain hole 255. The drain center tool 300 includes crosshair grooves 310 that are perpendicular to each other and intersect to indicate the center of the drain center tool 300, which in turn indicates the center of the drain hole 255 and the center of the drain 250 once the shower base 210 is installed. During placement of the drain center tool 300 into the drain hole 225, the installer can rotate the drain center tool 300 until one of the grooves is parallel to the back edge 260 of the shower base 210 and the other groove is parallel to the side edges 270, 280 of the shower base 210. To facilitate such manual placement of the drain center tool 300, the drain centering tool 300 includes a pair of tabs 320 that the installer can use to rotate the drain center tool 300 within the drain hole 255 until it reaches its desired position and orientation. The drain center tool 300 can be fabricated from transparent or translucent material so that the installer can see through the drain center tool 300 to make sure that it is positioned correctly relative to the drain hole 225. In other embodiments, the drain center tool 300 can be fabricated from opaque materials as well.

Once the drain center tool 300 is positioned in the drain hole 255 and rotated to the installer's preferred position and orientation, the installer can place the hook of the tape measure in the appropriate groove and extend the tape measure in order to the back edge 270 and the side edges 280, 290 and record the three measurements. The crosshair grooves 310 are sufficiently deep so that the hook of a tape measure can be captured in the groove 310 for ease and accuracy of measurements. Once the distances of the drain hole 255 to the edges 270, 280, 290 of the shower base 210 are recorded, the measurements are then used as a point of reference for accurately marking and trimming the back panel, wet wall, and side panel.

The recorded measurements can be used in a variety of methods for marking and trimming the shower panels to accommodate the particular shower base. Generally, the installer uses the recorded measurements to apply a vertical mark on the wet wall, side shower panel, and back shower panel that correspond to the location of the drain hole 255 prior to the wet wall, back shower panel, and side shower panel being installed onto the shower base 210. As will be understood, the distance of the drain hole 255 to the back edge 270 of the shower base 210 is used to mark the wet wall and side shower panel, and the distance of the drain hole 255 to the side edges 280, 290 of the shower base 210 are used to mark the back shower panel. The installer optionally can only record and use one of the distances from the drain hole 255 to the side edges 280, 290. However, for accuracy and redundancy, the installer typically measures the distance to both side edges 280, 290 of the shower base 210.

Figure 11:
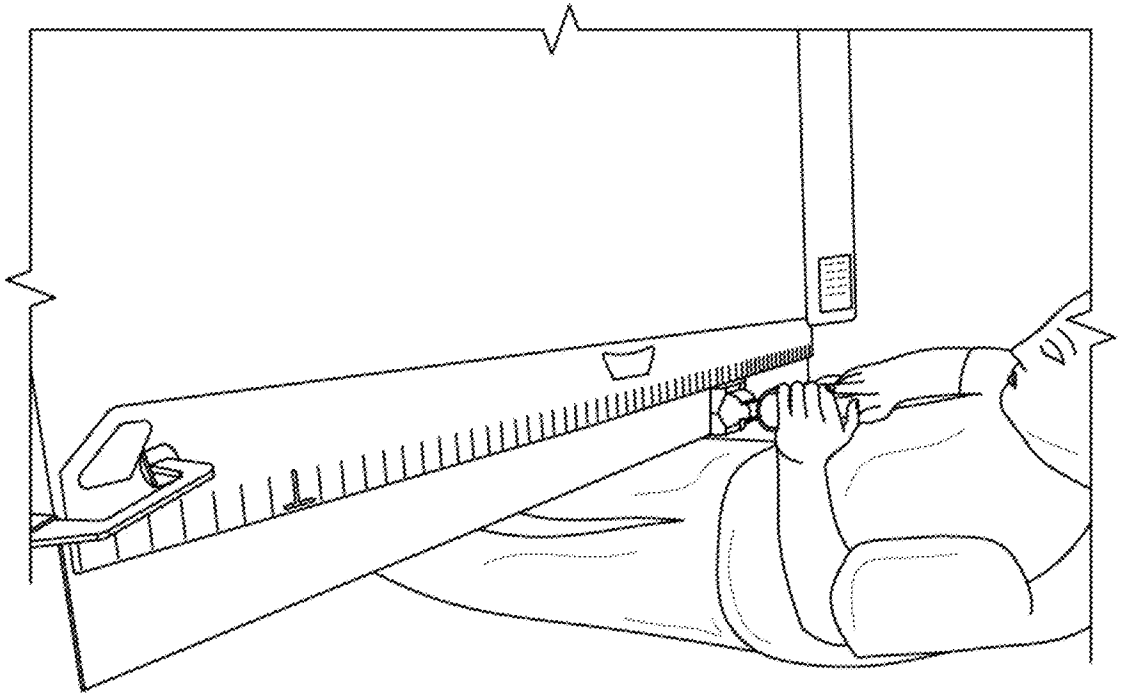
FIG. 11 is a schematic perspective view depicting a contour gauge tool clamped to a shower panel with an installer using the contour gauge tool as a guide to trim the panel with a saw.

Once the wet wall, back shower panel, and side shower panel have been marked, the installer uses the contour gauge tool 400 to trim the bottom edge of the shower panels. As noted above, the contour gauge tool 400 includes a t-shaped slot 410. The t-shaped slot 410 is cut through the contour gauge tool 400 so that when positioned on a shower panel, the installer can see through the t-shaped slot 410. The installer places the contour gauge tool 400 onto the shower panel to be trimmed and adjusts the position of the contour gauge tool 400 until the drain location mark on the shower panel is located at the intersection of the two slots that comprise the t-shaped slot 410. Once properly positioned, the installer can either trace along the bottom edge 410 of the contour gauge tool 400 or clamp the contour gauge tool 400 to the shower panel, as depicted in FIG. 11. If the installer elects to trace along the bottom edge 410 of the contour gauge tool 400, the installer then trims the shower panel with a saw following the traced path. If the installer elects to clamp the contour gauge tool 400 to the shower panel, the installer can use the edge of the contour gauge tool 400 as a physical guide and use a saw to trim the shower panel (as depicted in FIG. 11). Once the bottom edge of the shower panel is trimmed, the installer can, using the measurements for the location of the drain hole 255 relative to the shower panel, mark and cut the vertical sides of the shower panel and the top of the shower panel to properly fit into the space selected for the modular shower. It will be understood that the walls, floor and ceilings of many homes, particularly older homes, are not straight or "plumb." Thus, the cuts made by installer to trim the sides and top of the shower panel may need to be adjusted to accommodate the specific geometric contours of the intersection of the walls, floor, and ceiling of the bathroom.

In one specific embodiment of the method of using the tools described herein to trim shower panels, each shower panel includes a finished vertical edge with the other edges generally unfinished. The installer begins by installing the shower base. The installer inserts the drain center tool into the drain hole, appropriately positions and orients the drain center tool, makes measurements to three top edges of the shower base, and records such measurements. The installer then prepares the back shower panel by marking the drain hole location on the back shower panel relative to the finished edge of the back shower panel. The installer uses the contour gauge tool 400 to trim the bottom edge of the back shower panel. The installer then measures, marks, and trims the unfinished vertical edge opposite the finished edge and the top of the back shower panel. The installer then installs the back shower panel so that it interfaces with the applicable top edge of the shower base. The installer next prepares the wet wall by marking the drain hole location on the wet wall relative to the finished edge of the wet wall. The installer uses the contour gauge tool 400 to trim the bottom edge of the wet wall. The installer then measures, marks, and trims the unfinished vertical edge opposite the finished edge and the top of the wet wall. The installer then cuts appropriate holes to accommodate the showerhead and shower trim passing through the wet wall. The installer then installs the wet wall so that it interfaces with the applicable top edge of the shower base and the back shower panel. Finally the installer prepares the side shower panel by marking the drain hole location on the side shower panel relative to the finished edge of the side shower panel. The installer uses the contour gauge tool 400 to trim the bottom edge of the side shower panel. The installer then measures, marks, and trims the unfinished vertical edge opposite the finished edge and the top of the side shower panel. The installer then installs the side shower panel so that it interfaces with the applicable top edge of the shower base and the back shower panel. Once the shower base and all shower panels are installed, the modular shower is properly installed without any significant gaps between the shower base and shower panels. The use of the contour gauge tools significantly reduces the number of steps required to trace and trim all shower panels that interface with the sloped top surface of the shower base. By reducing the number of steps required to trace and trim all shower panels that interface with the sloped top surface of the shower base, this also significantly reduces the chance for error when performing these methods which are required for finishing a shower installation to the degree that it will be accepted both functionally and aesthetically by the home owner.

As best illustrated in FIG. 8, the bottom edge 420 of the contour gauge tool 400 is rounded. The contour of the bottom edge 420 of the contour gauge tool 400 is designed to match the contour of the applicable edge of the shower base as determined by the drain position relative to the wall being cut. The shower bases are fabricated with a few standard sizes but are routinely customized to accommodate a specific bathroom. However, the position of the drain to the contours of any possible edge of the shower base remains constant. Therefore, as long as the drain is used as the main point of reference, regardless of what final dimensions the shower base is customized for, contour gauge tools can be made so that they properly replicate the contours of the edges of the shower base.

The contour gauge tool 400 includes a few additional convenient features. For example, the contour gauge tool 400 includes graduated distance markings along the bottom edge 420 so that the contour gauge tool 400 can also be used to measure distances for marking, etc. In this example, the markings are centered around the t-shaped slot 410. The contour gauge tool 400 includes an opening 430 that can be used by the installer to control the contour gauge tool 400 while positioning it on the shower panel. Additionally, the opening 430 can be used to conveniently carry around the contour gauge tool 400. Additional holes 440 can be formed in the contour gauge tool 400 to conveniently hang and store the tool 400 when not in use.

Figure 12:
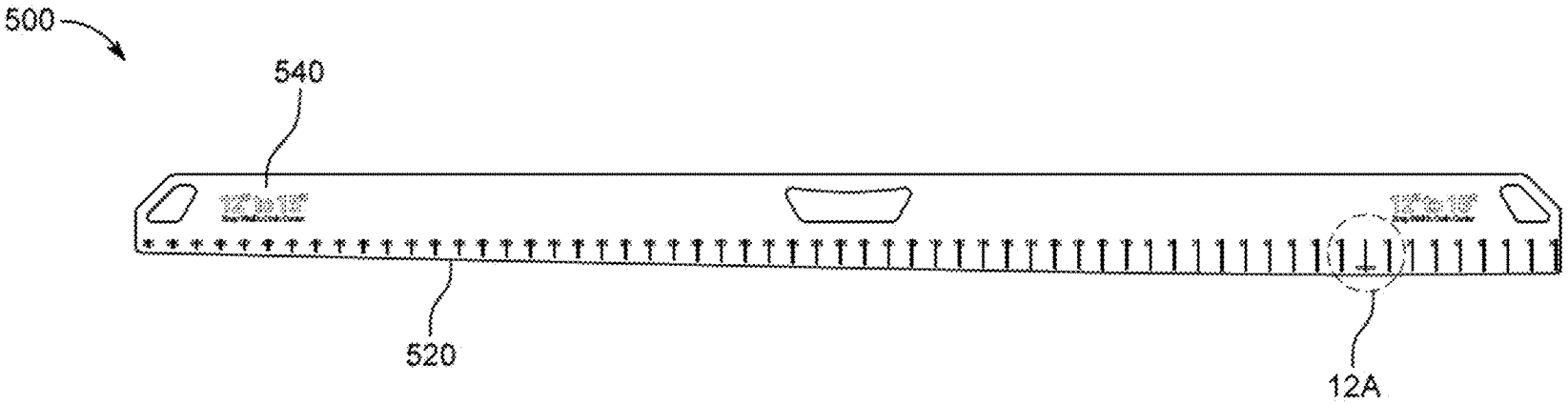
FIG. 12 schematically illustrates a front plan view of another contour gauge tool.
Figure 12A:
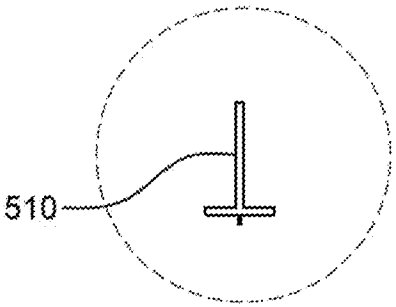
FIG. 12A illustrates a t-shaped slot of the contour gauge tool of FIG. 12.

As noted above, there are multiple contour gauge tools that are designed for various sizes and drain configurations for shower bases as well as whether the shower panel is a wet wall, the opposing side shower panel, or back shower panel. For example, the contour gauge tool 400 of FIGS. 7 and 8 is designed to measure the distance from the drain to the edge of the shower base that will engage with the wet wall. The contour gauge tool 400 includes the t-shaped slot 410 at the mid-point of the contour gauge tool 400 because this tool is designed for a pre-fabricated shower base, to be later customized for a specific application, which has a pre-fabricated drain location centered between the back shower panel and the shower opening and shower threshold location. In contrast, FIG. 12 illustrates a contour gauge tool 500 for measurements to the edge of the shower base that engages with the back shower panel. The contour gauge tool 500 includes a t-shaped slot 510 offset to the right (relative to FIG. 12). This arrangement is for use with a shower base with an offset drain. The drain position is offset with respect the wet wall side panel and the second side panel. It is further noted that the bottom edge 520 of the contour gauge tool 500 is not rounded like contour gauge tool 400, but instead, the bottom edge 520 continues to slant downward toward the t-shaped slot 510. This is because the shower base slopes downward toward to drain to efficiently channel water out of the shower. For all contour gauge tools, the t-shaped slot represents the drain location which is always the lowest point on the shower base.

Figure 13:
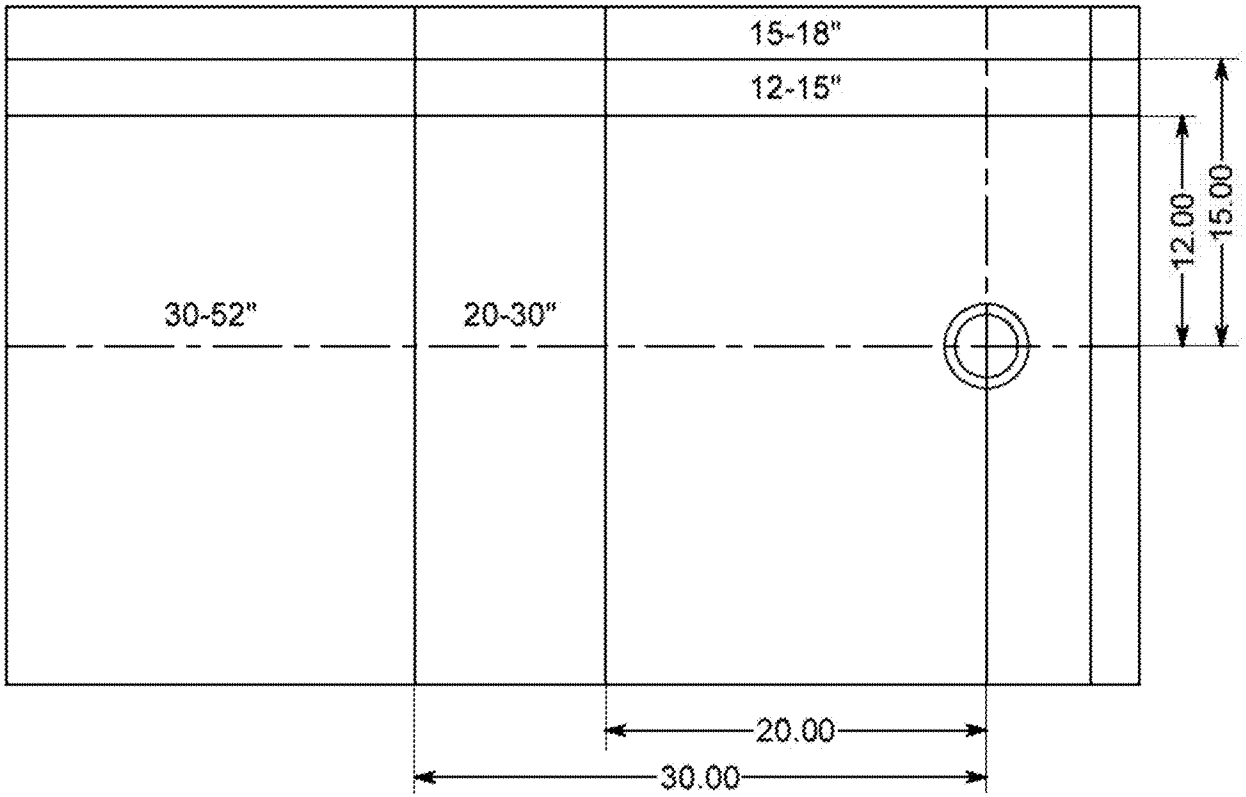
FIG. 13 is a schematic top plan view illustrating various sizes of shower bases.
Figure 14:
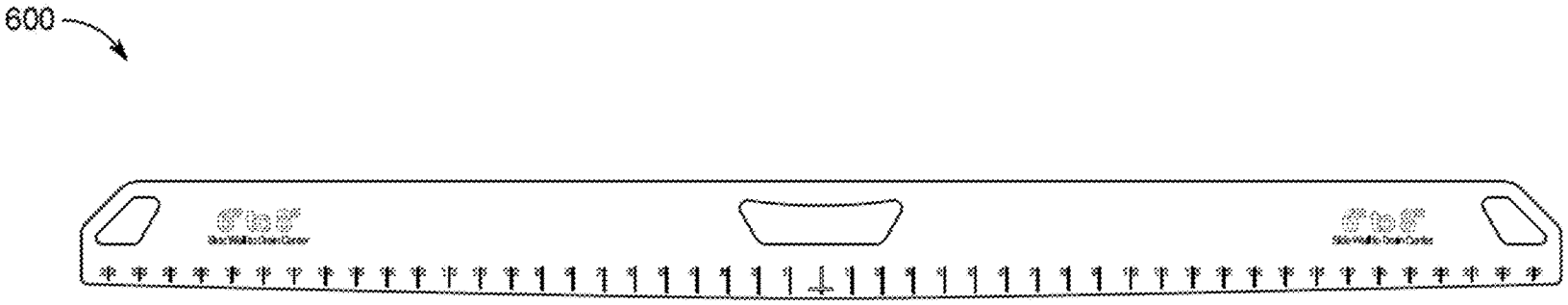
FIG. 14 schematically illustrates a front plan view of another contour gauge tool.
Figure 15:
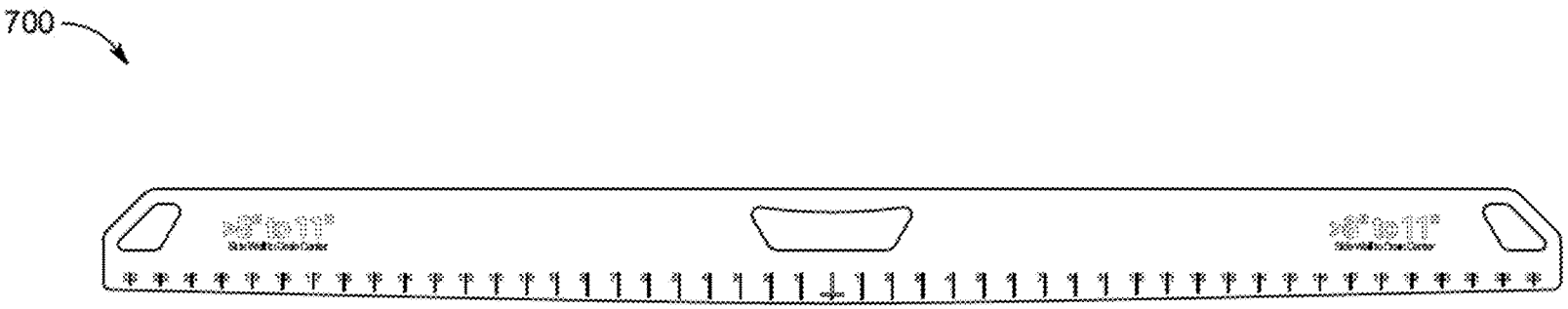
FIG. 15 schematically illustrates a front plan view of another contour gauge tool.
Figure 16:
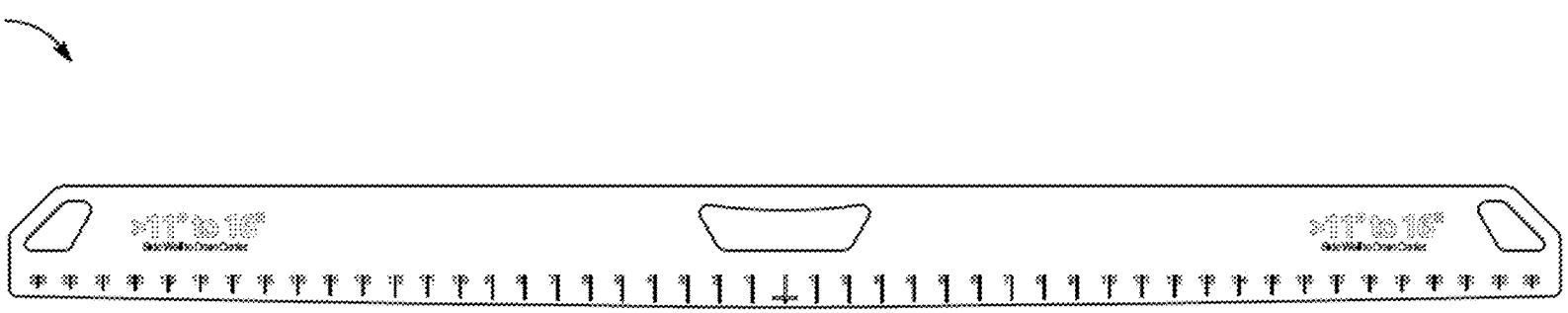
FIG. 16 schematically illustrates a front plan view of another contour gauge tool.
Figure 17:
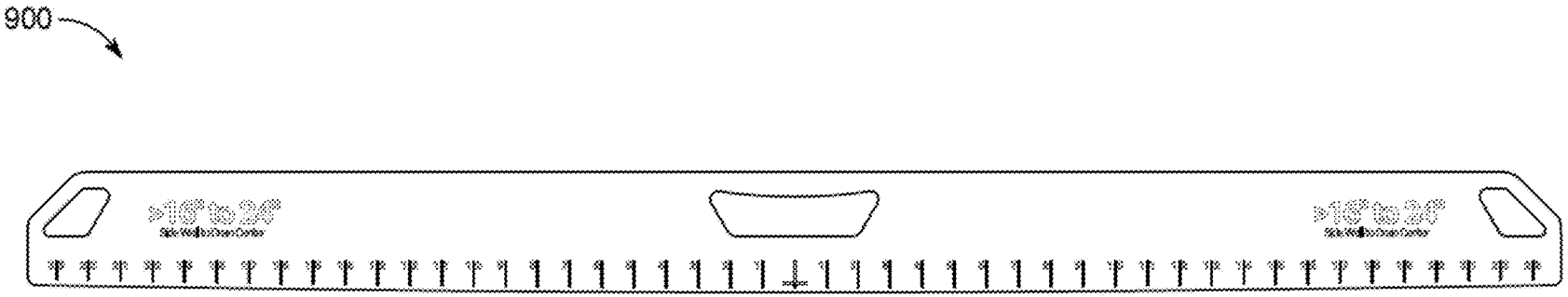
FIG. 17 schematically illustrates a front plan view of another contour gauge tool.
Figure 18:
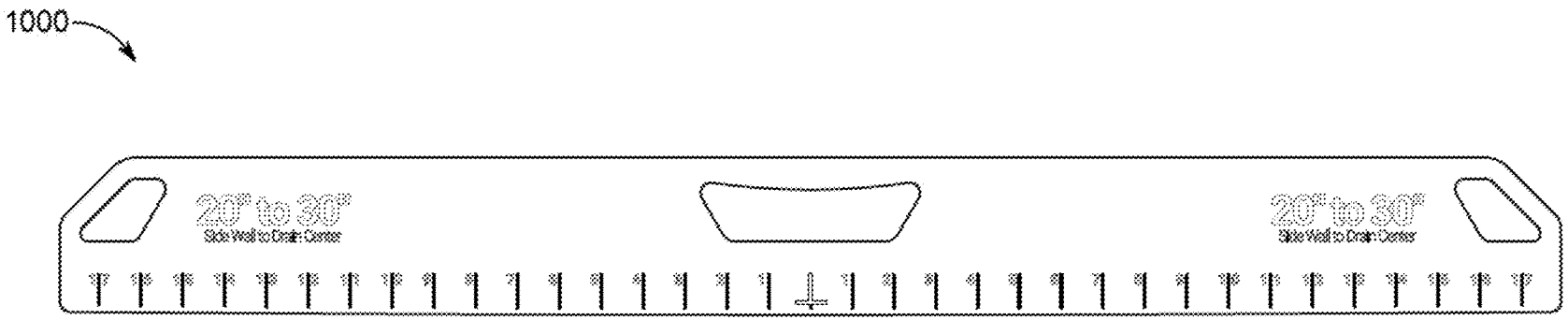
FIG. 18 schematically illustrates a front plan view of another contour gauge tool.
Figure 19:
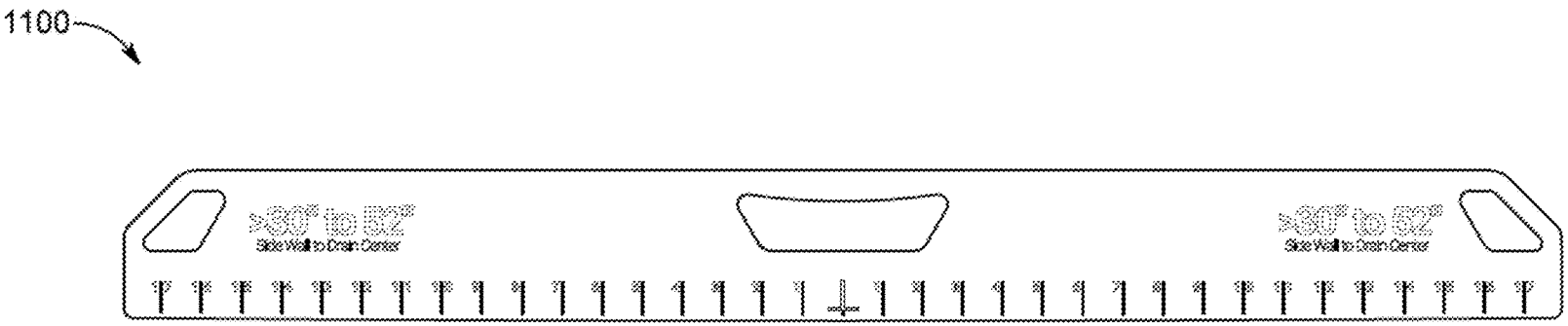
FIG. 19 schematically illustrates a front plan view of another contour gauge tool.
Figure 20:
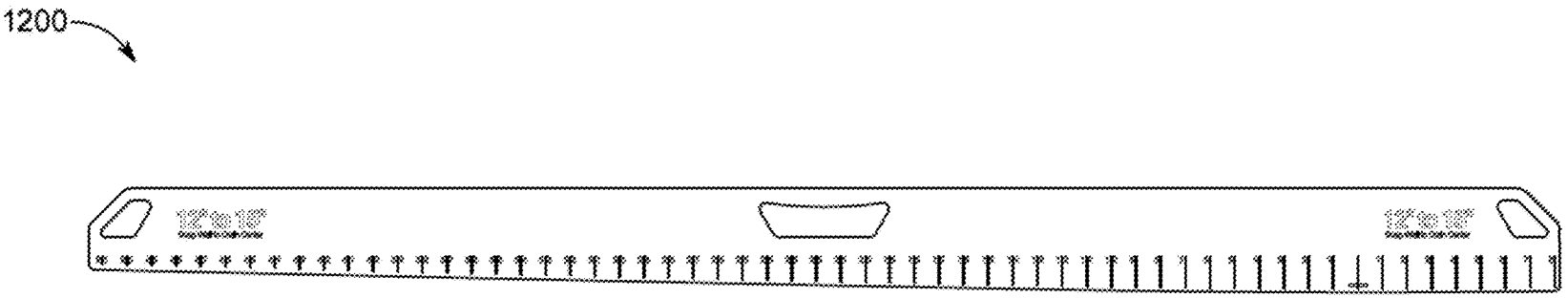
FIG. 20 schematically illustrates a front plan view of another contour gauge tool.
Figure 21:
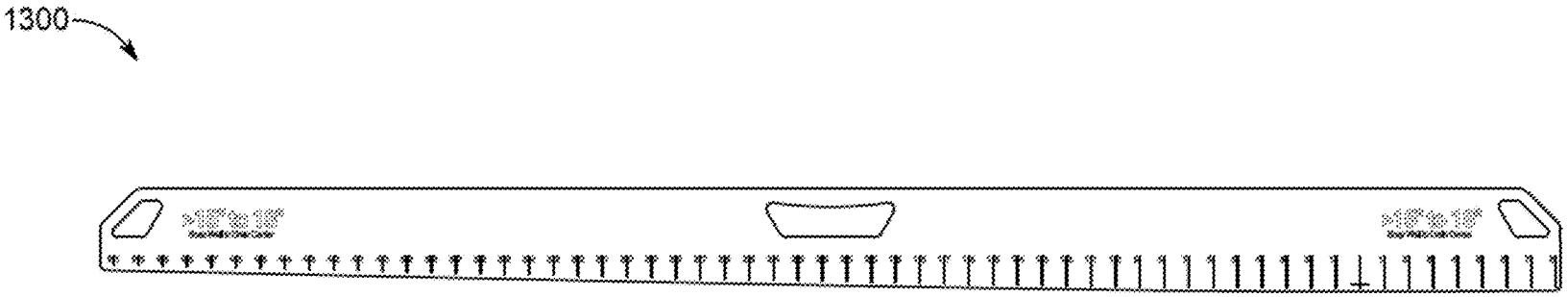
FIG. 21 schematically illustrates a front plan view of another contour gauge tool.

Additionally, different contour gauge tools can be arranged for use based on the distance of the drain from an edge of the shower base. FIG. 13 illustrates a number of different possibilities for the distance of an offset drain to the edges of the shower base. Referring again to FIG. 12, the contour gauge tool 500 is designed for a modular offset drain shower base and a back shower panel that will be 12 inches to 15 inches away from the drain center (see range 540 engraved on tool). In FIG. 14, the contour gauge tool 600 is designed for a modular centered drain shower base and a side shower panel that will be between 6 inches to 8 inches away from the drain center. In FIG. 15, the contour gauge tool 700 is designed for a modular centered drain shower base and a side shower panel that will be more than 8 inches and up to 11 inches away from the drain. It is noted the "greater than" sign is used to indicate the distance should be greater than 8 inches because if the distance is 8 inches, the contour gauge tool 600 of FIG. 14 should be used. In FIG. 16, the contour gauge tool 800 is designed for a modular centered drain shower base and a side shower panel that will be more than 11 inches and up to 16 inches away from the drain center. In FIG. 17, the contour gauge tool 900 is designed for a modular centered drain shower base and a side shower panel that will be more than 16 inches and up to 24 inches away from the drain center. In FIG. 18, the contour gauge tool 1000 is designed for a modular offset drain shower base and a second side shower panel that will be between 20 inches to 30 inches away from the drain center. In FIG. 19, the contour gauge tool 1100 is designed for a modular offset drain shower base and a second side shower panel that will be more than 30 inches and up to 52 inches away from the drain center. In FIG. 20, the contour gauge tool 1200 is designed for a modular offset drain shower base and a back shower panel that will be 12 inches to 15 inches away from the drain center. In FIG. 21, the contour gauge tool 1300 is designed for a modular offset drain shower base and a back shower panel that will be more than 15 inches and up to 18 inches away from the drain center.

Figure 22:
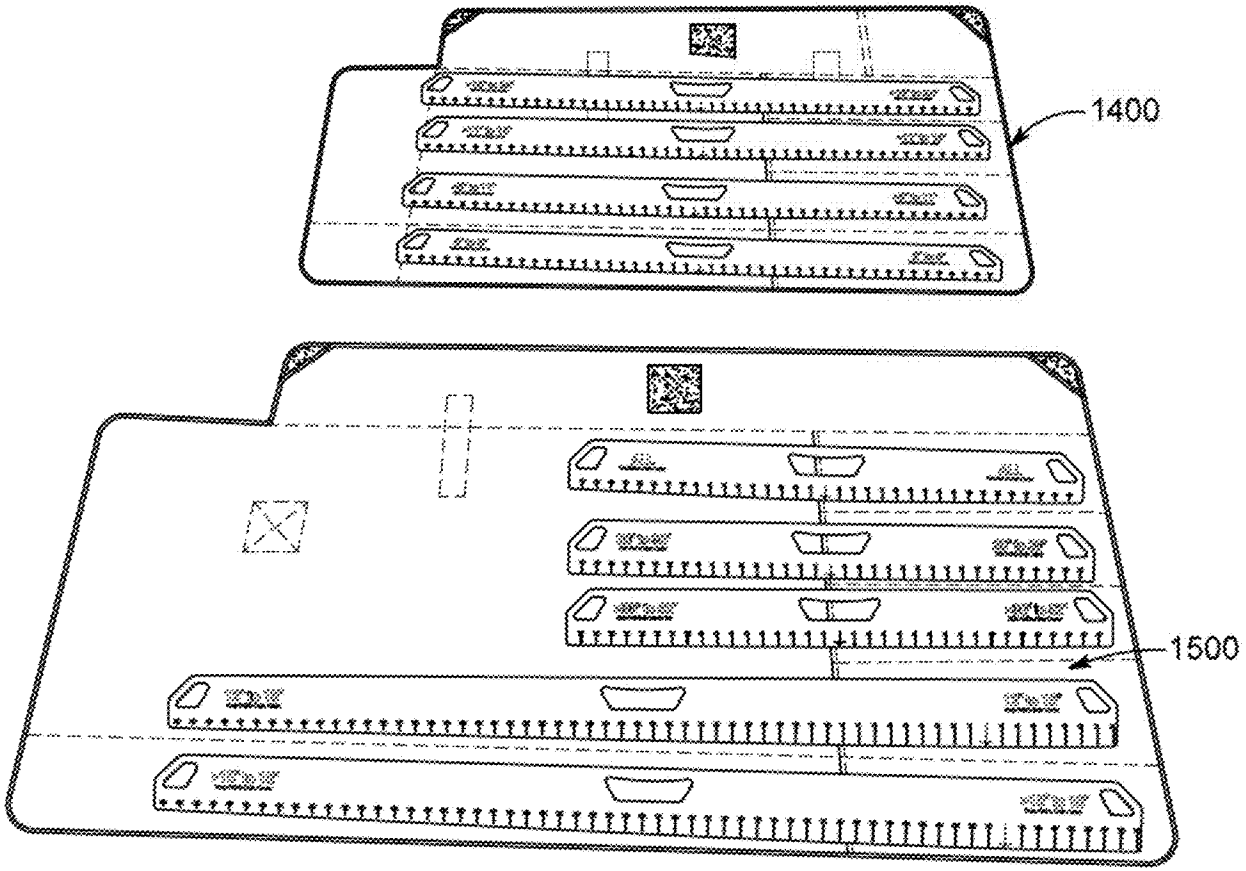
FIG. 22 is a schematic perspective view depicting contour gauge tools and carrying cases for contour gauge tools.
Figure 23:
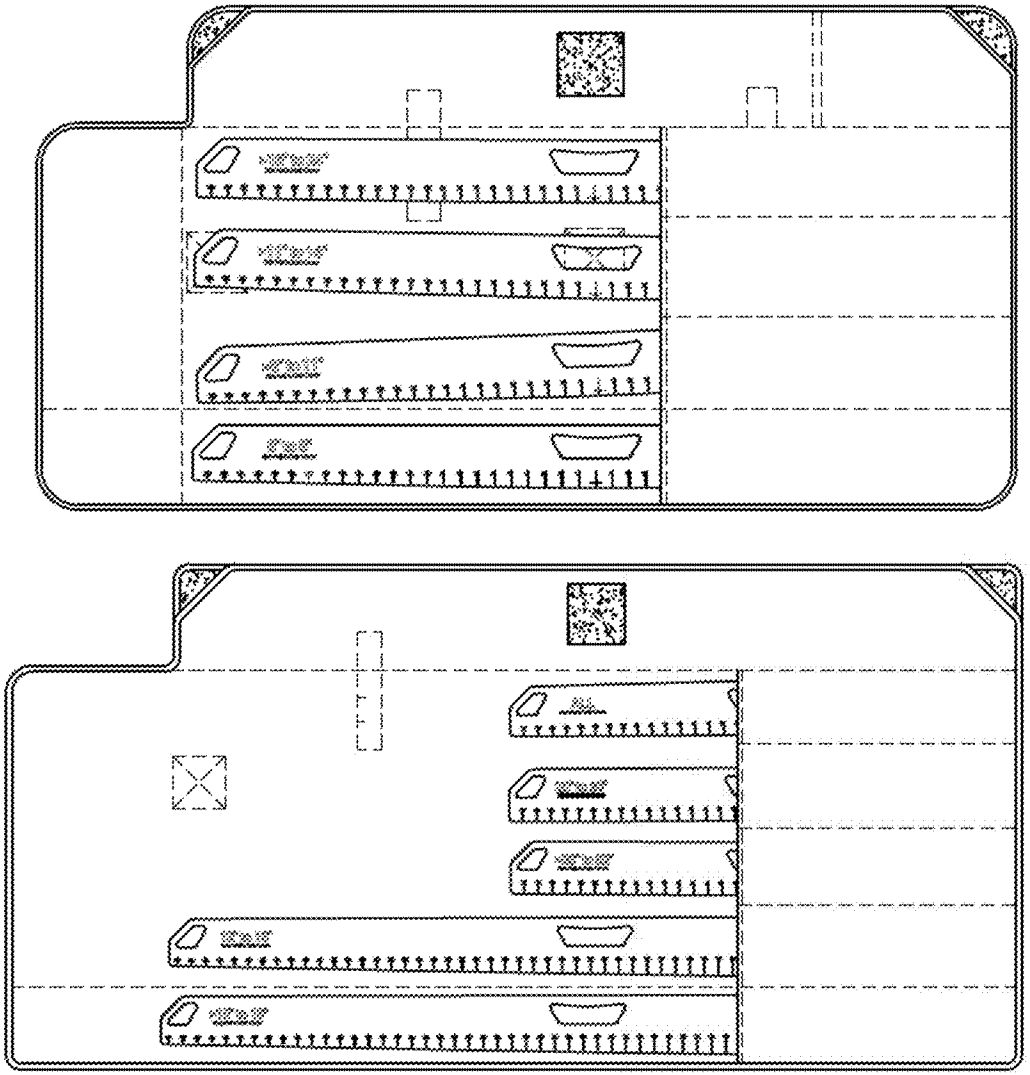
FIG. 23 is a schematic perspective view depicting contour gauge tools positioned in slots of carrying cases.
Figure 24:
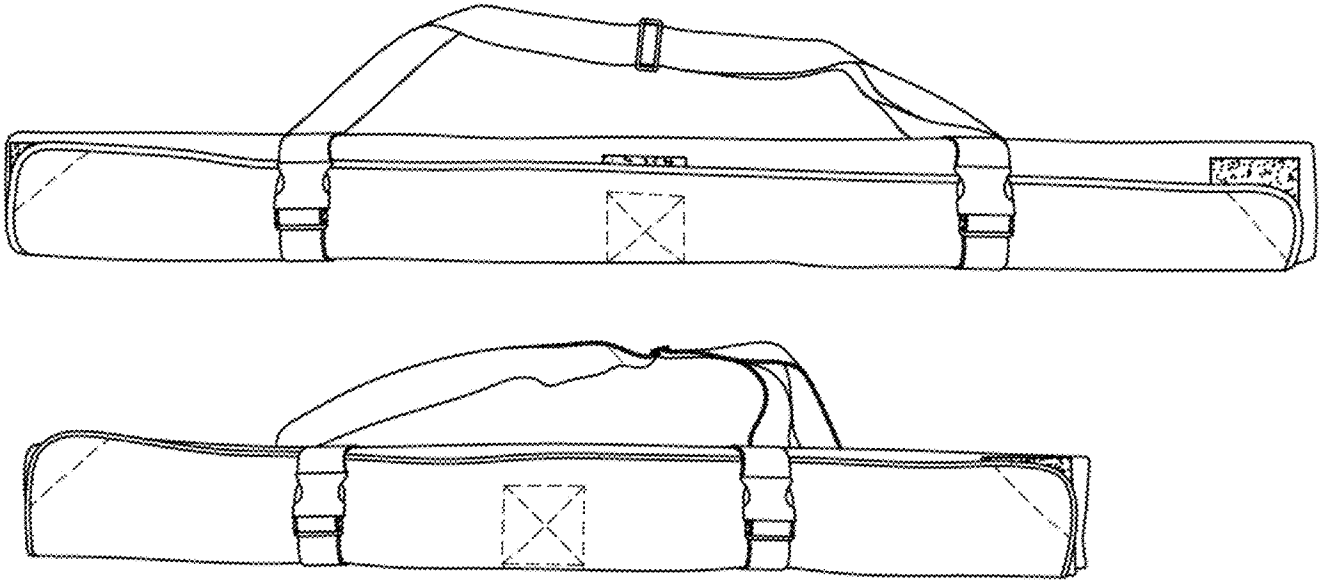
FIG. 24 is a schematic perspective view depicting a carrying case for contour gauge tools rolled up for ease of transport and storage.

It is useful for an installer to have access to all the contour gauge tools when installing a modular shower. As illustrated in FIGS. 22-24, carrying cases can be designed to store and carry contour gauge tools. In the example of FIGS. 22-24, there is a first carrying case 1400 for the contour gauge tools for center drain shower bases, and a second carrying case 1500 for contour gauge tools for offset drain shower bases. The contour gauge tools can be tucked into slots or pockets in the carrying cases 1400, 1500, and the carrying cases 1400, 1500 can be rolled up for ease to transport and storage.

The contour gauge tools provided herein are only examples of contour gauge tools that accommodate shower bases. It will be understood that the ideas and arrangements disclosed herein can be applied to any number of contour gauge tools for various styles and sizes of shower bases.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

We claim:

1. A method of preparing and installing shower panels for a modular shower, comprising:

selecting prefabricated components including a shower base, a back shower panel, a first side shower panel, and a second side shower panel, wherein:

the shower base includes a first top edge, a second top edge, a third top edge, and a drain hole;

the back shower panel includes a left vertical edge, a right vertical edge, a top edge, and a bottom edge;

the first side shower panel includes a left vertical edge, a right vertical edge, a top edge, and a bottom edge; and the second side shower panel includes a left vertical edge, a right vertical edge, a top edge, and a bottom edge;

measuring a first distance from the drain hole to the first top edge, measuring a second distance from the drain hole to the second top edge, and measuring a third distance from the drain hole to the third top edge;

placing a first indicator on the first side shower panel proximate to the bottom edge of the first side shower panel corresponding with the second distance;

placing a second indicator on the back shower panel proximate to the bottom edge of the back shower panel that corresponds with the first distance and the third distance;

placing a third indicator on the second side shower panel proximate to the bottom edge of the second side shower panel corresponding with the second distance;

aligning one of a plurality of contour gauge tools with the first indicator and trimming the bottom edge of the first side shower panel based on the contour gauge tool;

aligning one of the plurality of contour gauge tools with the second indicator and trimming the bottom edge of the back shower panel based on the contour gauge tool; and aligning one of the plurality of contour gauge tools with the third indicator and trimming the bottom edge of the second side shower panel based on the contour gauge tool.

2. The method of claims 1, wherein each of the plurality of contour gauge tools includes a slot formed through the contour gauge tool, wherein the slot is used to align one of the plurality of contour gauge tools with the first indicator, align one of the plurality of contour gauge tools with the second indicator, or align one of the plurality of contour gauge tools with the third indicator.

3. The method of claim 2, wherein the steps of trimming the bottom edges of the first side shower panel, back shower panel, and second side shower panel based on one of the plurality of contour gauge tools includes using the contour gauge tool to mark a desired shape of the bottom edges and trimming along the mark.

4. The method of claim 2, wherein the steps of trimming the bottom edges of the first side shower panel, back shower panel, and second side shower panel based on one of the plurality of contour gauge tools includes reversibly securing the contour gauge tool at a position that represents a desired shape of the bottom edges and using the contour gauge tool as a guide to trim the bottom edges.

5. The method of claim 2, wherein each of the plurality of contour gauge tools includes a contoured edge, where the steps of trimming the first side shower panel, second side shower panel, and the back contoured panel based on one of the plurality of contour gauge tools includes using the contoured edge of the contour gauge tool to trim the panels.

6. The method of claim 5, wherein the placement of the slot on each of the plurality of contour gauge tools is determined by the placement of the drain hole in the shower base.

7. The method of claim 6, wherein the shape of the contoured edge of each of the plurality of contour gauge tools is determined by whether the contour gauge tool is for use with the first side shower panel, second side shower panel, or back shower panel.

8. The method of claim 5, wherein the contoured edge of each of the plurality of contour gauge tools is arranged to simulate a contour of one of the top edges of the shower base.

9. The method of claim 2, wherein the slot of each of the plurality of contour gauge tools is arranged to correlate with a location of the drain hole in the shower base.

10. The method of claim 9, wherein the slot of each of the plurality of contour gauge tools is generally centered relative to the length of the contour gauge tool if the location of the drain hole in the shower base is centered.

11. The method of claim 9, wherein the slot of each of the plurality of contour gauge tools is generally offset from center relative to the length of the contour gauge tool if the location of the drain hole in the shower base is offset.

12. The method of claim 1, wherein when the shower base, the back shower panel, the first side shower panel, and the second side shower panel are installed:

the first side shower panel engages with the first top edge of the shower base;

the back shower panel engages with the second top edge of the shower base; and the second side shower panel engages with the third top edge of the shower base.

13. The method of claim 1, wherein:

the left vertical edge of the first side shower panel is a finished edge and the right vertical edge and the top edge of the first side shower panel are trimmed;

one of the left vertical edge and the right vertical edge of the back shower panel is trimmed and the top edge of the back shower panel is trimmed; and the right vertical edge of the second shower panel is a finished edge and the left vertical edge and the top edge of the second side panel are trimmed.

14. The method of claim 13, wherein:

the trimming of the right vertical edge of the first side shower panel is based on the first indicator;

the trimming of the left vertical edge or right vertical edge of the back shower panel is based on the second indicator; and the trimming of the left vertical edge of the second side shower panel is based on the third indicator.

15. The method of claim 13, wherein:

the bottom edge of the first side shower panel is trimmed prior to the trimming of the right vertical edge of the first side shower panel;

the bottom edge of the back shower panel is trimmed prior to the trimming of the left vertical edge or right vertical edge of the back shower panel; and the bottom edge of the second side shower panel is trimmed prior to the trimming of the left vertical edge of the second side shower panel.

16. The method of claim 1, wherein:

the right vertical edge of the first side shower panel is a finished edge and the left vertical edge of the first side shower panel are trimmed;

one of the right vertical edge and the left vertical edge of the back shower panel is trimmed and the top edge of the back shower panel is trimmed; and the left vertical edge of the second shower panel is a finished edge and the right vertical edge of the second side panel are trimmed.

17. The method of claim 1, wherein the measuring of the first distance, the second distance, and third distance is facilitated by a drain center tool.

18. The method of claim 17, wherein the drain center tool includes:

a first groove;

a second groove intersecting the first groove and perpendicular to the first groove; and at least one tab extending upward of the top surface of the drain center tool.

19. The method of claim 18, wherein the step of measuring of the first distance, the second distance, and third distance facilitated by a drain center tool includes:

placing the drain center tool in the drain hole;

orienting the drain center tool in the drain hole;

placing a hook of a tape measure in the first or second groove of the drain center tool;

extending the tape measure to one of the first, second, or third top edge of the shower base; and noting the distance from the drain center tool to the first, second or third top edge of the shower base.

20. The method of claim 19, wherein the step of orienting the drain center tool in the drain hole includes:

arranging the drain center tool such that the first groove is generally perpendicular to the first and third top edges of the shower base; and arranging the drain center tool such that the second groove is generally perpendicular to the second top edge of the shower base.

21. The method of claim 18, wherein the least one tab is arranged to provide for manual manipulation of the drain center tool.

22. The method of claim 1, wherein each of the plurality of contour gauge tools includes indicia formed on a surface of the contour gauge tool that indicates the purpose of the contour gauge tool.

23. The method of claim 1, wherein the contour gauge tool selected for use from the plurality of contour gauge tools is selected based on the placement of the drain hole, and which one of the first side shower panel, the back shower panel, or the second side shower panel is to be trimmed.

* * * * *